US009046267B2

(12) United States Patent
Muste et al.

(10) Patent No.: US 9,046,267 B2
(45) Date of Patent: Jun. 2, 2015

(54) LIGHTER WITH PIEZOELECTRIC IGNITION

(75) Inventors: Jordi Muste, Tarragona (ES); Eloi Gonzalvo, Tarragona (ES); Josep Altes, Tarragona (ES)

(73) Assignee: SOCIETE BIC, Clichy (FR)

( * ) Notice: Subject to any disclaimer, the term of this patent is extended or adjusted under 35 U.S.C. 154(b) by 804 days.

(21) Appl. No.: 13/377,697

(22) PCT Filed: Jun. 11, 2010

(86) PCT No.: PCT/EP2010/058237

§ 371 (c)(1),
(2), (4) Date: Feb. 21, 2012

(87) PCT Pub. No.: WO2010/142788

PCT Pub. Date: Dec. 16, 2010

(65) Prior Publication Data

US 2012/0141945 A1 Jun. 7, 2012

(30) Foreign Application Priority Data

Jun. 11, 2009 (FR) ..... 09 53913

(51) Int. Cl.
*F23Q 2/28* (2006.01)

(52) U.S. Cl.
CPC ..... *F23Q 2/287* (2013.01)

(58) Field of Classification Search
CPC ..... F23Q 2/28; F23Q 7/12; F23Q 2/16
USPC ..... 431/153, 276, 277, 344, 255
See application file for complete search history.

(56) References Cited

U.S. PATENT DOCUMENTS

| | | | | |
|---|---|---|---|---|
| 3,860,385 | A * | 1/1975 | Nakanishi | 431/344 |
| 4,243,377 | A * | 1/1981 | Schmid | 431/344 |
| 4,466,788 | A * | 8/1984 | Nitta | 431/255 |
| 5,492,468 | A * | 2/1996 | Cirami | 431/153 |
| 6,666,677 | B1 | 12/2003 | Ichikawa et al. | |
| 2004/0072114 | A1 * | 4/2004 | Doucet et al. | 431/344 |
| 2007/0259297 | A1 * | 11/2007 | Liu et al. | 431/153 |

FOREIGN PATENT DOCUMENTS

| | | |
|---|---|---|
| DE | 1632643 | 3/1967 |
| EP | 1 435 487 A1 | 7/2004 |
| FR | 2 551 535 | 8/1985 |

OTHER PUBLICATIONS

International Search Report (PCP/EP2010/058237).
French Search Report (FR 723273).

* cited by examiner

*Primary Examiner* — Gregory Huson
*Assistant Examiner* — Nikhil Mashruwala
(74) *Attorney, Agent, or Firm* — Jones Day

(57) ABSTRACT

A gas lighter that includes a valve that connects to a nozzle, a lever for controlling the opening of the valve, a piezoelectric system that includes a first and second electrode, where the first electrode is arranged downstream and on the side in relation to the nozzle, and a control member adapted to drive the opening of the valve and the creation of an electric arc when it is actuated. The second electrode is formed by a projection integral with the lever, the projection being made of electrically-conductive material. The top of the projection is arranged downstream of the nozzle and is substantially opposite the first electrode in relation to the central axis (Z) of the nozzle during the actuation of the control member in order to be at a distance from the first electrode.

9 Claims, 2 Drawing Sheets

FIG.3A.
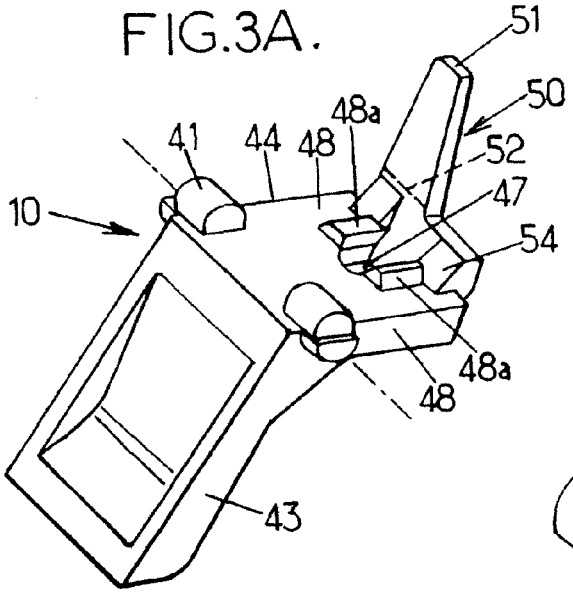
FIG.3B.
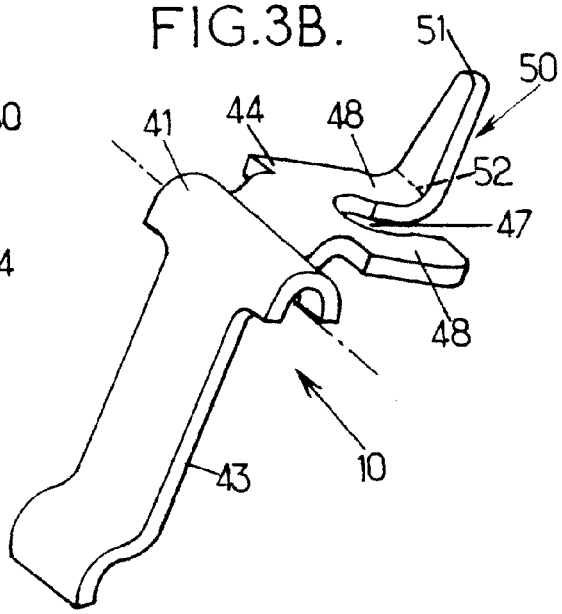
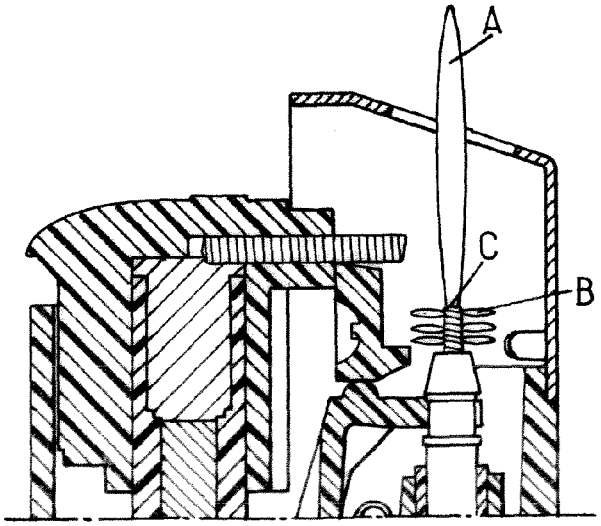
FIG.4.
PRIOR ART

LIGHTER WITH PIEZOELECTRIC IGNITION

CROSS REFERENCE TO RELATED APPLICATION

This application is a national stage application of International Application No. PCT/EP2010/058237 filed on Jun. 11, 2010, which claims priority to French Patent Application No. 0953913 filed on Jun. 11, 2009, the entire contents of both applications being incorporated herein by reference.

FIELD OF INVENTION

The embodiments of the present invention relate to a gas lighter, in particular, of the cigarette lighter type, of which ignition is obtained using a piezoelectric system. More particularly, the embodiments of the present invention relate to a gas lighter that includes:

- a valve connected to a gas outlet nozzle defining a central axis;
- a control lever for opening the valve;
- a piezoelectric system comprising a voltage generator connected to a first electrode, arranged downstream and on the side in relation to the gas outlet nozzle, and to a second electrode; and
- a control member adapted to drive the opening of the valve by the intermediary of the lever and the creation of an electric arc between the first and second electrodes when it is actuated.

BACKGROUND OF THE INVENTION

Lighters of this type have been marketed for many years with a certain commercial success thanks to an ignition that is facilitated in relation to the conventional friction wheel lighters. Indeed, the production of a flame using a wheel lighter requires two movements (rotation of the wheel and pressing on a plunger) from the user, although with a piezoelectric lighter it requires only a pressing movement on a plunger.

Nevertheless, the manufacture of piezoelectric ignition lighters is more complex, not only due to the presence of a piezoelectric generator, but also due to the fact that particular precautions must be taken in order to ensure the ignition of the air/gas mixture. Indeed, the electric arc has an extremely short duration, as well as a limited energy. Therefore, the lighters marketed of this type systematically adopt on the gas outlet nozzle an additional device to the friction wheel lighters. The function of this device on the one hand is to create one or several secondary gas flows and, on the other hand, to constitute a second electrode arranged in a region propitious to the ignition. These secondary gas flows must have a speed and an output flow that are much less than the main flow in order to favor the mixture with the ambient air and attain a proportion that is close to the stoichiometry, between 1 and 8% of gas, making ignition possible. It is widely accepted that such a diffusing device is required in order to obtain a stoichiometric zone that is sufficiently extended for the ignition of a piezoelectric lighter.

In the vast majority of cases, this device is formed by a helical spring with spaced spires of very small diameter and mounted via insertion into the orifice of the gas outlet nozzle. This embodiment is shown in FIG. 4 and described in numerous patents, as for example FR2551535 or EP1435487. A dispensing device carried out by a spring represents an extra cost, but above all the mounting of this spring of small dimensions via insertion into the nozzle complicates the manufacture substantially. During use, it may occur that the spring becomes deformed, or even pulled off of the nozzle, due to the introduction of a foreign body behind the windshield cover.

In order to limit these disadvantages, it has been proposed to realize the diffusing device using a cap mounted on a nozzle having an auxiliary output orifice, as described in U.S. Pat. No. 6,672,861. This solution requires, however, an additional part of small dimensions and a nozzle having an auxiliary orifice, which does not make it possible to directly use the standard nozzles manufactured in very large quantity for the friction wheel lighters.

SUMMARY OF THE EMBODIMENTS OF THE PRESENT INVENTION

An object of an embodiment of the present invention is to reduce the manufacturing cost of a piezoelectric ignition lighter, in particular by simplifying its manufacture. Of course, the reliability of the piezoelectric ignition must not be degraded substantially.

To this effect, the embodiment of the present invention has for purpose a lighter of the aforementioned type, characterized in that the second electrode is formed by a projection integral with material of the lever of electrically-conductive material and extending up to a top, the top being arranged downstream of the nozzle and in a way that is substantially opposite the first electrode in relation to the central axis of the nozzle during the actuation of the control member in order to be at a distance from the first electrode which is adapted for the formation of an electric arc.

It has been observed that an entirely satisfactory ignition of the lighter was obtained, despite the absence of a secondary orifice delivering a flow of gas at reduced speed, and despite a slightly greater distance between the electrodes than with the conventional systems comprising a spring diffusing device inserted into the nozzle. This can be explained by the fact that with this arrangement of the electrodes, the electric arc crosses a zone surrounding the stream of pure gas wherein the gas/air mixture is sufficiently close to the stoichiometric ratio, and that this zone is nevertheless sufficiently extended in order to obtain the ignition of the lighter.

The fact that the projection forming the second electrode is of a single part with the lever can also contribute to this result by improving the electrical conductivity and therefore the passage of the weak current in the circuit going from the piezoelectric generator to the second electrode. Indeed, in prior art, this current is transmitted via the lever, the nozzle and then the dispensing device, which can generate losses in particular at the articulation between the lever and the nozzle.

Note that the manufacturing of the lighter is substantially simplified, since, as such, the lever forms a single part fulfilling two functions. There is no longer a part to be mounted on the nozzle and the latter can be an entirely standard nozzle for friction wheel lighters.

In the preferred embodiments of the invention, recourse may be had, furthermore, to one or the other of the following arrangements:

- the projection forming the second electrode has preferably the form of a triangular plate of which the base is integral with the lever; this arrangement offers a good compromise between the solidity of the second electrode and the precision of the departure of the electric arc on the latter;
- the lever has two branches surrounding an engagement portion of reduced exterior section connected to the valve, and the projection forming the second electrode extends from at least one of the ends of the two branches;

the top of the projection forming the second electrode is located at a radial distance from the central axis between 1 and 5 mm and more preferably about 2 mm, at the moment of the creation of the electric arc;

the top of the projection forming the second electrode is located at a longitudinal distance according to the central axis between 2 and 8 mm, and more preferably of about 4 mm, from the nozzle during the creation of the electric arc;

the longitudinal distances according to the central axis measured from the nozzle, from the end of the first electrode and from the top of the projection forming the second electrode are identical amongst themselves to the nearest 2 mm during the creation of the electric arc; these value ranges appear preferable in order to obtain the ignition with a cigarette lighter comprising a standard device for delivering gas and without having recourse to a piezoelectric generator with power that is greater than those currently used, the top of the projection is at a longitudinal distance starting from the nozzle and measured according to the central axis, which is less than the longitudinal distance from the end of the first electrode, during the creation of the electric arc;

the lever and the projection forming the second electrode are made of an injection-moulded electrically-conductive synthetic resin; this makes it possible to obtain a second electrode of a relatively complex and precise form without extra cost except for the quantity of the material required for the projection, the lever and the projection forming the second electrode made from a metal plate.

BRIEF DESCRIPTION OF THE DRAWINGS

Other characteristics and advantages of the invention shall come from the description which shall follow, provided by way of a non-limitating example, in reference to the drawings wherein:

FIG. 3*a* is a perspective view of the control lever of FIGS. 1 and 2;

FIG. 3*b* is a view analogous to FIG. 3*a* showing an alternative embodiment of the control lever;

FIG. 4 is view analogous to FIG. 2 showing the prior art.

DESCRIPTION OF PREFERRED EMBODIMENTS OF THE INVENTION

In the various figures, the same references designate identical or similar elements.

Figure 1:
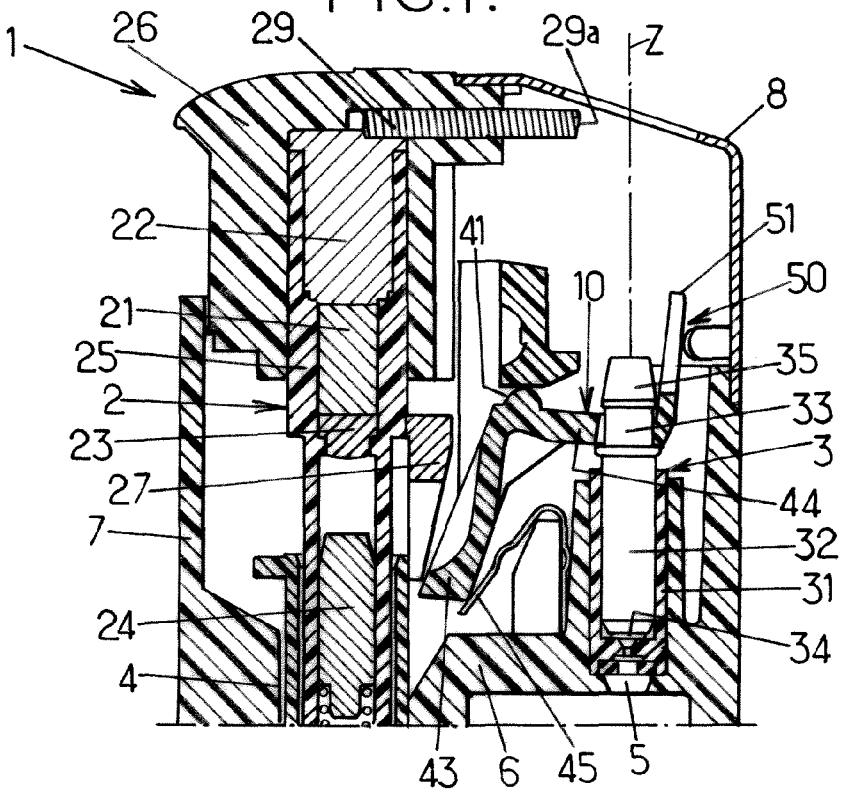
FIG. 1 is a simplified cross-section view of the head of a lighter comprising a device for dispensing gas with a control lever according to an embodiment of the invention, and for which the lever is in a rest position.

In FIG. 1, is partially shown as a cross-section a gas lighter 1 according to the invention, and more particularly a cigarette lighter.

The lighter 1 comprises a piezoelectric ignition device 2 and a device for dispensing gas 3 mounted respectively in a well 4 and a through duct 5 formed in the upper wall 6 of a reservoir of plastic material. The reservoir is extended beyond the upper wall 6 by a structure 7 which is used in particular as a support for a metal windshield cover.

The piezoelectric ignition device 2 comprises a piezoelectric element 21, a plate 22, a backing plate 23 and a plexor 24 mounted in a tubular body 25. An actuator button 26 is fixed to the upper end of the tubular body 25. A metal wedge 27 is mounted laterally on the tubular body 25 and is electrically connected to the backing plate 23. These elements forming a unit guided in vertical sliding by the upper structure 7 of the reservoir and a sleeve inserted into the well 4.

Figure 2:
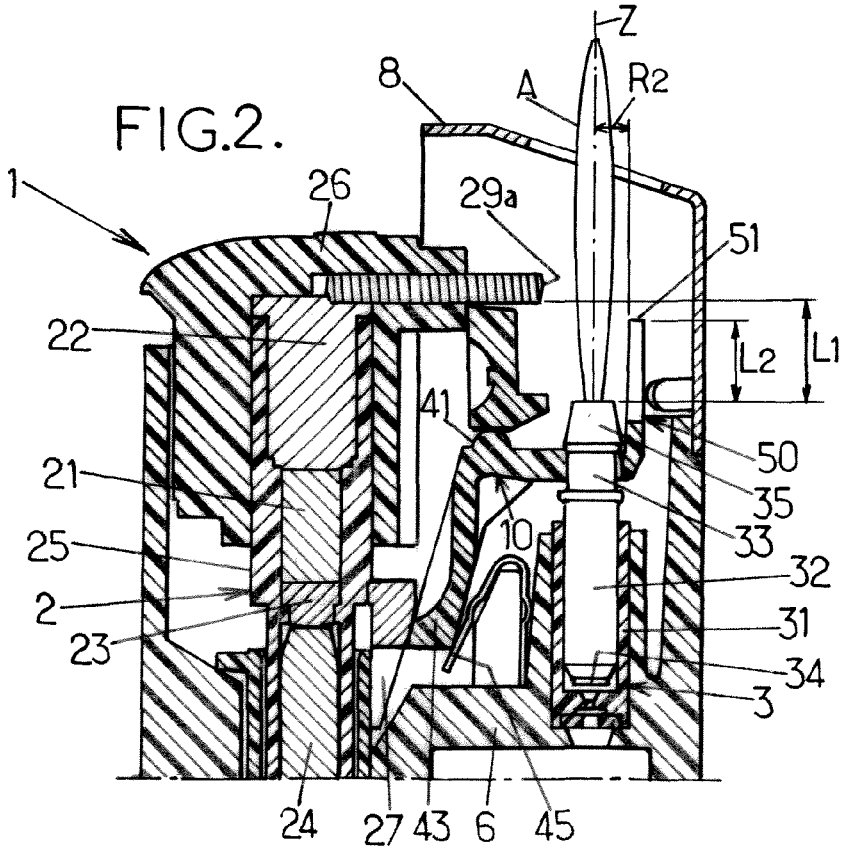
FIG. 2 is a view analogous to FIG. 1 wherein the control lever is in ignition position.

The actuator button 26 is therefore mobile vertically between an upper rest position, shown in FIG. 1, wherein it is solicited by a spring not shown, and an ignition position attained when the user exerts a sufficiently high pressure. When the ignition position shown in FIG. 2 is attained, the plexor 24 strikes the backing plate 23 and the piezoelectric element 21 generates a high voltage (of a magnitude of 15,000 volts) which is transmitted to a first electrode 29. The first electrode 29 is formed by a spring with joined spires mounted in the actuator button 26 in plastic, in such a way that an interior end of the latter comes into contact with the plate 22 and that a free exterior end 29*a* is located in the space protected by the windshield cover 8.

The free end 29*a* of the first electrode 29 is arranged in relation to a second electrode 50 for which details will be provided in what follows, in such a way that the high voltage generates an electric arc between the latter. On the other hand, the wedge element 27 connected to the backing plate 23 comes into contact with the control lever 10 and drives a pivoting of the latter.

The device for dispensing gas 3 is entirely standard. It includes a cylindrical body 31, at the lower end of which a porous membrane is retained by a washer. The porous membrane makes it possible to adjust the flow of gas coming from the reservoir, whether this is gas in vapor phase or in liquid phase in contact therewith. A hollow rod 32 is mounted slidingly in the cylindrical body 31. This hollow rod 32 carries a buffer 34 at its lower end, which constitutes a valve sealing the reduced passage when the rod 32 is in its low position. The hollow rod 32 has, at the exterior of the cylindrical body 31, an engagement portion 33 formed by a portion with reduced exterior section and delimited longitudinally by two radial breaks. This engagement portion 33 comes into engagement with the control lever 10, in such a way that the pivoting of the latter drives a rising and a descending of the hollow rod 32 in the cylindrical body 31 between a lowered position shown in FIG. 1 for which the dispensing device 3 is sealed, and a raised position shown in FIG. 2 for which the dispensing device delivers gas via a nozzle 35.

The nozzle 35 is here entirely formed with the hollow rod 32 but other constructions are possible. The nozzle 35 has a single orifice located in the plane of the top of the nozzle. This orifice is formed by the opening of a cylindrical duct, it therefore has a circular form and a central axis Z arranged vertically, as can be seen in the FIGS. 1 and 2.

The control lever 10 is mounted pivoting on an axis 41 carried by the upper structure 7 of the reservoir.

As it can be better seen in FIG. 3*a*, the lever 10 has a first arm 43 extending in an inclined manner and to the left of the axis 41 in the figures. This arm 43 has a free end against which comes to bear a wedge element 27 when the button 26 is actuated. The lever 10 comprises a second arm 44 extending substantially horizontally and to the right of the axis 41 in the figures, in such a way that the lever preferably has an open-V configuration. A spring 45, here carried out in the form of a V-shaped blade, exerts a pressure under the first arm 43 in order to solicit the lever 10 towards its rest position shown in FIG. 1.

The second arm 44 has a window 47 delimited by two parallel branches 48. These branches 48 are spaced and conformed, in particular on their boss 48*a*, in such a way as to cooperate with the engagement portion 33 of the hollow rod 32 with a certain play.

The end of the second arm 44 of the lever 10 has a projection 50 extending in a substantially perpendicular manner to this arm and upwards in the figures, to a top 51.

The top 51 is therefore located on the downstream side in relation to the plane of the opening of the nozzle 35 and slightly offset in relation to the central axis Z, whether the lever 10 is in rest position or in ignition position.

The projection 50 plays the role of second electrode of the piezoelectric ignition system. It must however be notes that it is the position of the top 51 of the projection 50 when the lever 10 is in ignition position, i.e. when the piezoelectric ignition system 2 delivers a voltage that can generate an electric arc. This position of the top 51 must be located downstream of the opening of the nozzle 35 and offset in relation to the central axis Z, and be on the side opposite the first electrode 29. It is not required for the geometric center of the top 51 to be positioned in a manner exactly diametrically opposite the free end 29*a* of the first electrode in relation to the central axis Z, an offset is possible. Nevertheless, it is preferable that the line connecting these points crosses a zone wherein the content in gas delivered by the nozzle 35 is 100% when the valve 34 of the dispensing device 3 is fully open. The edge of this pure gas zone is shown by the plot A in FIG. 2. However, this line must not pass in a clearly separated manner in relation to the zone A, in particular at a distance greater than one time the diameter of this zone at the point considered, if a satisfactory ignition is to be obtained.

On the other hand, it will appear clearly to those skilled in the art that the distance between the free end 29*a* of the first electrode and the top 51 remain in a range that allows for the formation of an electric arc that is sufficiently energetic at the moment when the lever 10 is in ignition position.

As can be seen better in FIG. 3, the projection 50 preferably has the form of a triangular plate of which the tip forms the top 51 and the base 52 is integral with the lever 10. This triangular form, in the form of an extended triangle in the embodiments shown, provide a top with relatively small dimensions which makes it possible to precisely locate the end of the electric arc while still providing the projection 50 with substantial solidity, and in any case that is more than a simple rod.

The projection 50 comes from material with the lever 10, i.e. it is constituted of the same material and has a perfect continuity with the latter in order to form only a single part. This part must be made of electrically-conductive material so that the projection 50 fulfils its function of second electrode of the piezoelectric ignition device 2.

In the first embodiment of the lever 10 shown in FIGS. 1, 2 and 3A, this entails a part with a synthetic resin base made electrically conductive, for example by incorporating a certain proportion of good electrically-conductive particles. The lever 10 is carried out with this plastic material via injection moulding, which makes it possible to obtain parts with great precision. The projection 50 does not complicate the moulding method due to its triangular form that is easily removed from the mould.

Note that the base 52 of the projection 50 is carried by a bar 54, which can be seen in FIG. 3A, which connects the two free ends of the branches 48 of the second arm. This reinforces the solidity of the second arm and the elastic nature of the synthetic resin allows for an engagement of the nozzle 35 through the window 47 with a slight snapping, in particular on bosses 48*a* on the engagement portion 31.

As can also be seen in FIG. 3A, the base 52 of the projection 50 is located on one side of the bar 54 at the end of the left branch 48. But a more central position and a base of the projection connecting symmetrically the two arms, can be considered.

An alternative embodiment of the lever 10 is shown in FIG. 3B. In this alternative, the lever 10 is formed by a metal plate, therefore perfectly conductive, which is formed via entirely conventional operations of cutting, stamping and folding.

It can be noted that the electrode 50 has in this alternative a base 52 connected only to the end of the left branch 48. This is in fact an extension of this branch that was curved at approximately 90 degrees via folding. Also note that the triangular form of the projection 50 provides the latter with a solidity and a rigidity on its base 52, while still having atop 51 with reduced dimensions making it possible to locate the electric arc with good precision.

The window 47 is here open in order to engage laterally the second arm 44 on the engagement portion 33 of a device for dispensing gas that is perfectly identical to the device 3. Only the upper structure 7 of the reservoir must be modified in order to support the pivoting axis 41 of the different structure for this alternative embodiment.

The ignition operation of the lighter is perfectly identical regardless of the alternative embodiment of the lever 10 retained. It takes place in the following manner.

The user presses with the thumb on the control button 26 thus causing the descent of the backing plate 23 and of the wedge element 27, until triggering the impact of the plexor 24 when the configuration in FIG. 2 is attained. During the descending movement of the button, the wedge element 27 acts on the first arm 43 of the lever 10 driving a pivoting of the latter. The second arm 44 carried out an arc of circle of a few degrees in the anti-clockwise direction, which drives an upward movement of the hollow rod 32. This movement of the hollow rod raises the buffer 34 forming the valve, and a delivery of the gas via the output nozzle 35.

At the moment of the impact of the plexor 24, i.e. in the configuration shown in FIG. 2, the piezoelectric element 21 delivers a very high voltage which is transmitted, on the one hand, to the first electrode 29 by the intermediary of the plate 22 and, on the other hand, to the second electrode formed by the projection 50. The transmission to the second electrode 50 is carried out by the intermediary of the backing plate 23, the wedge element 27 connected to the latter, the first arm 43 of the lever 10 whereon is bearing the wedge element 27, and the second arm 44 carrying the projection 50. Note that the first arm 43, the second arm 44 and the projection 50 are formed of a single conductive part and that consequently the electrical conductivity is not penalized by the effects of contact. In this configuration, the first and second electrodes (29, 50) must be sufficiently close, according to the voltage delivered and the other elements present, so that an electric arc is created between the latter. More precisely, the arc is created between the closest zones, i.e. between the side of the top 51 turned towards the free end 29*a* and the lower portion of this free end 29*a*.

A reliable and repeated ignition of the gas exiting from the nozzle 35 and mixed with the air was able to be obtained. This, despite the absence of a dispensing device which was considered until now required in order to obtain the ignition using a piezoelectric generator. As shown in FIG. 4, a lighter from prior art comprising a piezoelectric system and a device for dispensing gas comparable in all points, included in addition a dispensing device C formed by a helical spring with non-joined spires. The interstice between the spires of the spring C of small dimensions, had for function to deliver an auxiliary gas flow B in the form of a helical layer. The plot B shows, as for the plot A of the main flow, the zone where the ratio is still 100%. The auxiliary flow B has an ejection speed and a flow that is much lower than the main flow A and a mixture with the air is as such obtained in a wide zone in the intermediate vicinity of the dispensing spring C and up to encompassing the free end of the spring mounted on the actuator button. The electric arc created between the free end of the spring forming the first electrode and the upper left end of the dispensing spring C, the arc was therefore almost entirely included in an air/gas mixture zone, and did not cross the main pure gas flow A.

The obtaining of a reliable ignition with a device according to the embodiment of the present invention depends of course on several parameters such as the voltage, the current and the duration of the electrical discharge generated by the piezoelectric system 2, the characteristics of the gas flow A delivered by the nozzle 35, the characteristics of the circulation of air inside the space delimited by the cover, but also in a substantial way on the arrangement of the first and second electrodes (29, 50) in relation to this flow of gas.

For a standard cigarette lighter, i.e. of which the nozzle 35 and the characteristics of the exiting gas flow are identical to those of a friction wheel lighter due to the absence of a dispensing device, and with a piezoelectric generator identical to those used, it appears that the parameters for positioning the top 51 hereinafter are preferable. This entails positioning the top 51 in relation to the flow of gas and more precisely its central axis Z, as well as the relative positioning between this top 51 of the second electrode and the free end 29*a* of the first electrode. It is preferable to comply with the following characteristics.

The top 51 of the projection forming the second electrode is preferentially located at a radial distance R2 from the central axis Z between 1 and 5 mm. A shorter distance R2 would risk disturbing the exiting gas flow, while a longer distance would excessively separate the two electrodes. In the embodiment shown the distance R2 is approximately 2 mm. The radial distance R2, indicated in FIG. 2, must of course be measured in the configuration corresponding to the moment of the creation of the electric arc, the top 51 able to be much further separated in other configurations due to the movement of the control lever 10.

The top 51 of the projection 50 forming the second electrode is located at a longitudinal position L2 between 2 and 8 mm. This longitudinal position L2 of the top corresponds to the distance measured from the plane of the opening of the nozzle 35 and according to a direction parallel to the central axis Z. A shorter distance would position the electric arc closer to the nozzle 35 which would render the trajectory of the electric arc more random and could render the ignition more difficult. A longer distance is possible, but to the detriment of the space occupied by the ignition system under the screen 8. In the embodiment the distance L2 is approximately 4 mm during the creation of the electric arc.

The end 29*a* of the first electrode 29 is located at a longitudinal distance L1 of the nozzle 35 at the moment of the creation of an electric arc, i.e. when the button 26 is pressed. The longitudinal distances (L1, L2) of the first and second electrodes (29, 50) are chosen in such a way as to obtain an optimal inter-electrode distance for a good effectiveness for ignition and in order to guarantee the presence of the electric arc between the first and the second electrode. More preferably, the distances L1 and L2 do not differ by more than 2 mm at the moment of the creation of the electric arc which is as such relatively perpendicular to the flow of gas.

In the event of a difference between the distances L1 and L2, it is preferable that it is the top 51 of the projection 50 forming second electrode that is closer to the nozzle 35, so that L2 is less than L1, in order to limit the size of the projection 50.

Of course, the embodiments shown hereinabove in relation with a lighter of the cigarette lighter type, are not in any way restricted. Geometric alternatives, and even structural alternatives, remaining in the scope defined by the claims hereinafter, are possible. By way of example, the lever 10 which here carries out a tilting around its center axis 41, can have a movement that is substantially different, and even a movement of translation. The nozzle 35 here is integrally mobile with the buffer 34 forming a valve, but for other types of lighters, as for example barbecue lighters, it is possible to provide that the nozzle be connected to the valve via a flexible duct. The projection 50 forming the second electrode can be carried out in many forms other than a triangular plate and even have several tips as long as the latter are arranged to obtain at least one electric arc able to ignite the flow of gas.

The invention claimed is:

1. A gas lighter comprising:

a valve connected to a gas outlet nozzle defining a central axis;

a lever for controlling the opening of the valve;

a piezoelectric system having a voltage generator connected to a first electrode and a second electrode, the first electrode being arranged downstream and on a side in relation to the gas outlet nozzle; and a control member adapted to open the valve by the intermediary of the lever, wherein an electric arc will be created between the first and second electrodes when the control member is actuated, and wherein the second electrode includes a projection integral with the lever, the projection including electrically-conductive material and extending to a top portion, the top portion being arranged downstream of the nozzle and substantially opposite the first electrode in relation to the central axis of the nozzle during the actuation of the control member in order to be at a distance from the first electrode, which is adapted for the formation of an electric arc.

2. The lighter according to claim 1, wherein the projection forming the second electrode has a triangular plate configuration, of which the base of the triangle is integral with the lever.

3. The lighter according to claim 1, wherein the lever has two branches surrounding an engagement portion of reduced exterior section connected to the valve, and wherein the projection forming the second electrode extends from at least one of the ends of the two branches.

4. The lighter according to claim 1, wherein the top of the projection is located a radial distance from the central axis, between 1 and 5 mm and more preferably, about 2 mm, at the moment of the creation of the electric arc.

5. The lighter according to claim 1, wherein the top of the projection is located between 2 and 8 mm, and more preferably about 4 mm, from the nozzle during the creation of the electric arc.

6. The lighter according to claim 1, wherein the longitudinal distance from the end of the first electrode to the top of the projection is approximately 2 mm, during the creation of the electric arc.

7. The lighter according to claim 1, wherein the longitudinal distance from the top of the projection to the nozzle is less than the longitudinal distance from the end of the first electrode to the nozzle, during the creation of the electric arc.

8. The lighter according to claim 1, wherein the lever and the projection forming the second electrode are carried out in an injection-molded conductive synthetic resin.

9. The lighter according to claim 1, wherein the lever and the projection forming the second electrode are carried out using a metal plate.

* * * * *